US009566585B2

(12) United States Patent
Van Mullem et al.

(10) Patent No.: US 9,566,585 B2
(45) Date of Patent: Feb. 14, 2017

(54) APPARATUS AND METHOD FOR LINER SYSTEM

(71) Applicant: Telsmith, Inc., Mequon, WI (US)

(72) Inventors: Albert Van Mullem, Sussex, WI (US); Matthew Haven, Cedarburg, WI (US); Chuck Dricken, Kewaskum, WI (US); Sean Neitzel, Kronenwetter, WI (US)

(73) Assignee: Telsmith, Inc., Mequon, WI (US)

( * ) Notice: Subject to any disclaimer, the term of this patent is extended or adjusted under 35 U.S.C. 154(b) by 427 days.

(21) Appl. No.: 14/346,213

(22) PCT Filed: Sep. 21, 2012

(86) PCT No.: PCT/US2012/056490
§ 371 (c)(1),
(2) Date: Mar. 20, 2014

(87) PCT Pub. No.: WO2013/043971
PCT Pub. Date: Mar. 28, 2013

(65) Prior Publication Data

US 2014/0224908 A1 Aug. 14, 2014

Related U.S. Application Data

(60) Provisional application No. 61/626,127, filed on Sep. 21, 2011.

(51) Int. Cl.

| | |
|---|---|
| ***B02C 2/04*** | (2006.01) |
| ***B02C 17/14*** | (2006.01) |
| ***B02C 2/00*** | (2006.01) |

(52) U.S. Cl.
CPC ..... *B02C 17/14* (2013.01); *B02C 2/005* (2013.01); *B02C 2/04* (2013.01); *B02C 2/045* (2013.01); *Y10T 29/49718* (2015.01)

(58) Field of Classification Search
USPC ..... 241/207–216
See application file for complete search history.

(56) References Cited

U.S. PATENT DOCUMENTS

| | | | | |
|---|---|---|---|---|
| 2,291,992 A * | 8/1942 | Stearns | B02C 2/06 | 241/156 |
| 2,885,156 A * | 5/1959 | Wolfe | B02C 17/22 | 241/182 |
| 2004/0202742 A1 * | 10/2004 | Winter | B29C 44/326 | 425/115 |

* cited by examiner

*Primary Examiner* — Mark Rosenbaum
(74) *Attorney, Agent, or Firm* — Chambliss, Bahner & Stophel, P.C.

(57) ABSTRACT

A liner system, adapted for use with a rock crusher having a support bowl and a concave ring. The liner system comprises a collet that is adapted to apply a force to the concave ring and a collet adjuster that is adapted to lower and raise the collet, in the preferred liner system, the concave ring is removably retained in the support bowl of the rock crusher by the liner system. A method for adjusting a collet comprising providing such a liner system and adjusting the collet adjuster so as to removably retain the concave ring.

21 Claims, 13 Drawing Sheets

APPARATUS AND METHOD FOR LINER SYSTEM

CROSS-REFERENCES TO RELATED APPLICATIONS/PATENTS

This application relates back to and claims priority from U.S. Provisional Application for Patent Ser. No. 61/626,127 titled "Liner System" and filed on Sep. 21, 2011.

FIELD OF THE INVENTION

The present invention relates generally to liner systems adapted for use in rock crushers, and particularly to retention systems for replaceable concave rings adapted for use on gyratory cone crushers.

BACKGROUND AND DESCRIPTION OF THE PRIOR ART

It is known to use a variety of devices and assemblies to retain a liner such as a concave ring in a rock crusher. Conventional devices and assemblies, however, suffer from one or more disadvantages. For example, conventional devices and assemblies are expensive, complex and unsafe. Conventional devices and assemblies also require excessive time and effort to install and remove a liner.

It would be desirable, therefore, if an apparatus and method for a liner system could be provided that would reduce the cost and complexity of the system and improve the safety of the system. It would also be desirable if such an apparatus and method could be provided that would reduce the time and effort required to install and remove a liner.

Advantages of the Preferred Embodiments of the Invention

Accordingly, it is an advantage of the preferred embodiments of the invention claimed herein to provide an apparatus and method for a liner system that reduces the cost and complexity and improves the safety of the system. It is also an advantage of the preferred embodiments of the invention claimed herein to provide an apparatus and method for a liner system that reduces the time and effort to install and remove the liner.

Additional advantages of the preferred embodiments of the invention will become apparent from an examination of the drawings and the ensuing description.

SUMMARY OF THE INVENTION

The apparatus of the invention comprises a liner system adapted for use with a rock crusher having a support bowl and a concave ring. The preferred liner system comprises a collet that is adapted to apply a force to the concave ting and a collet adjuster that is adapted to lower and raise the collet. In the preferred liner system, the concave ring is removably retained in the support bowl of the rock crusher by the liner system.

The method of the invention comprises a method for adjusting a collet. The preferred method for adjusting a collet comprises providing a liner system. The preferred liner system comprises a collet that is adapted to apply a force to the concave ring and a collet adjuster that is adapted to lower and raise the collet. In the preferred liner system, the concave ring is removably retained in the support bowl of the rock crusher by the liner system. The preferred method further comprises adjusting the collet adjuster so as to removably retain the concave ring.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
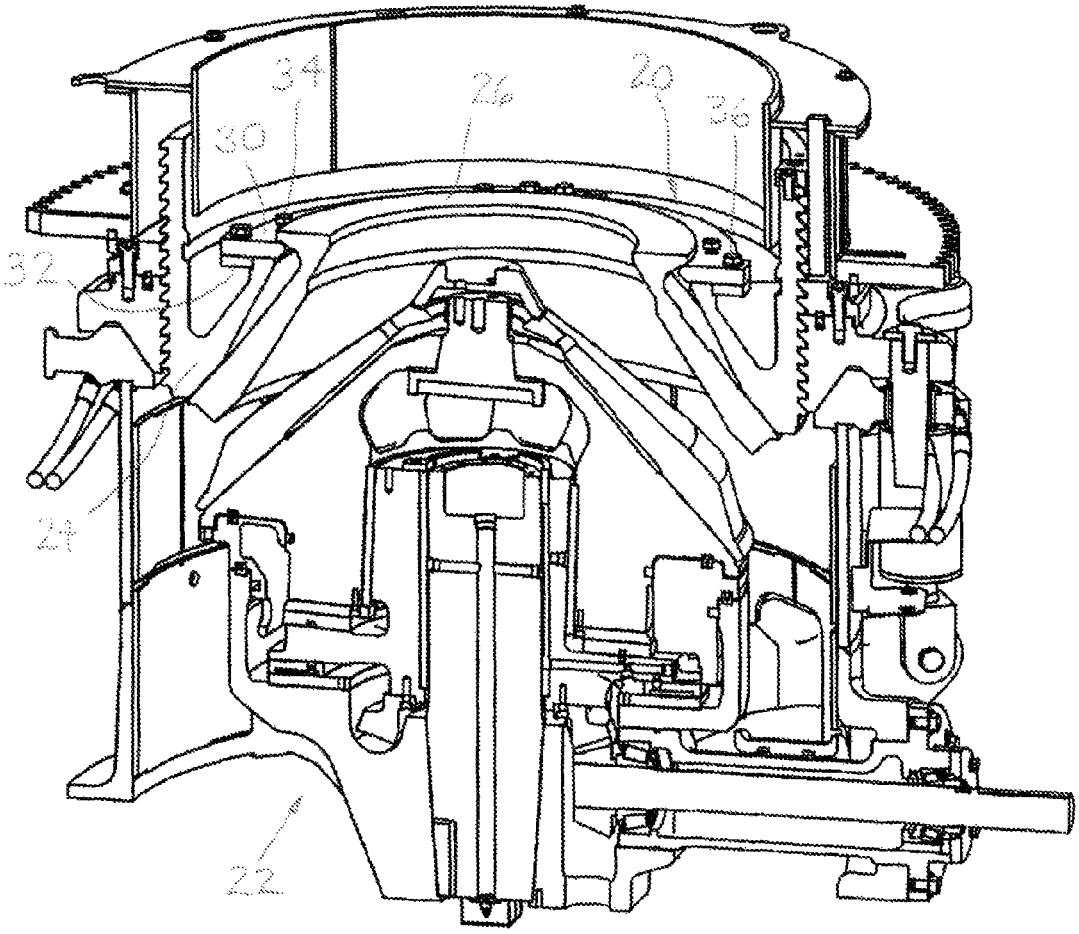
FIG. 1 is a sectional perspective view of an exemplary rock crusher including the preferred liner system in accordance with the present invention.

Referring now to the drawings, the preferred embodiments of the liner system in accordance with the present invention are illustrated by FIGS. 1 through 13. As shown in FIGS. 1-13, the preferred embodiments of the liner system claimed herein are adapted to reduce the cost and complexity and improve the safety of the liner systems. The preferred embodiments of the invention claimed herein also reduce the time and effort required to install and remove a liner.

Referring now to FIG. 1, a sectional perspective view of an exemplary rock crusher including the preferred liner system in accordance with the present invention is illustrated. As shown in FIG. 1, the preferred liner system is designated generally by reference numeral 20. The preferred liner system 20 is adapted for use with rock crusher 22. Rock crusher 22 includes support bowl 24 and a liner such as concave ring 26. The preferred liner system 20 comprises a collet, such as plurality of collet segments 30, which is adapted to apply a force to concave ring 26 so as to removably retain the concave ring in support bowl 24 of rock crusher 22. While preferred liner system 20 comprises a plurality dead segments 30, it is contemplated within the scope of the invention that the collet may be a one-piece, contiguous collet. The preferred liner system also comprises link plate 34.

Still referring to FIG. 1, the preferred link plate 32 is adapted to be attached to collet segments 30. The preferred liner system 20 also comprises collet adjuster 34. The preferred collet adjuster 34 is adapted to lower and raise collet 30. More particularly, preferred collet adjuster 34 is adapted to contact and apply a force to support bowl 24 and collet 30. The preferred collet adjuster 34 comprises a bolt, but it is contemplated within the scope of the invention that the collet adjuster may comprise an actuator, a wedge or any other suitable device, mechanism, assembly or combination thereof that is adapted to lower and raise the collet. Preferred liner system 20 further comprises link plate fastener 36 which is adapted to attach link plate 32 to collet 30. The preferred link plate fastener 36 comprises a bolt, but it is contemplated within the scope of the invention that the link plate fastener may comprise any other suitable device, mechanism, assembly or combination thereof that is adapted to attach a link plate to a collet.

Figure 2:
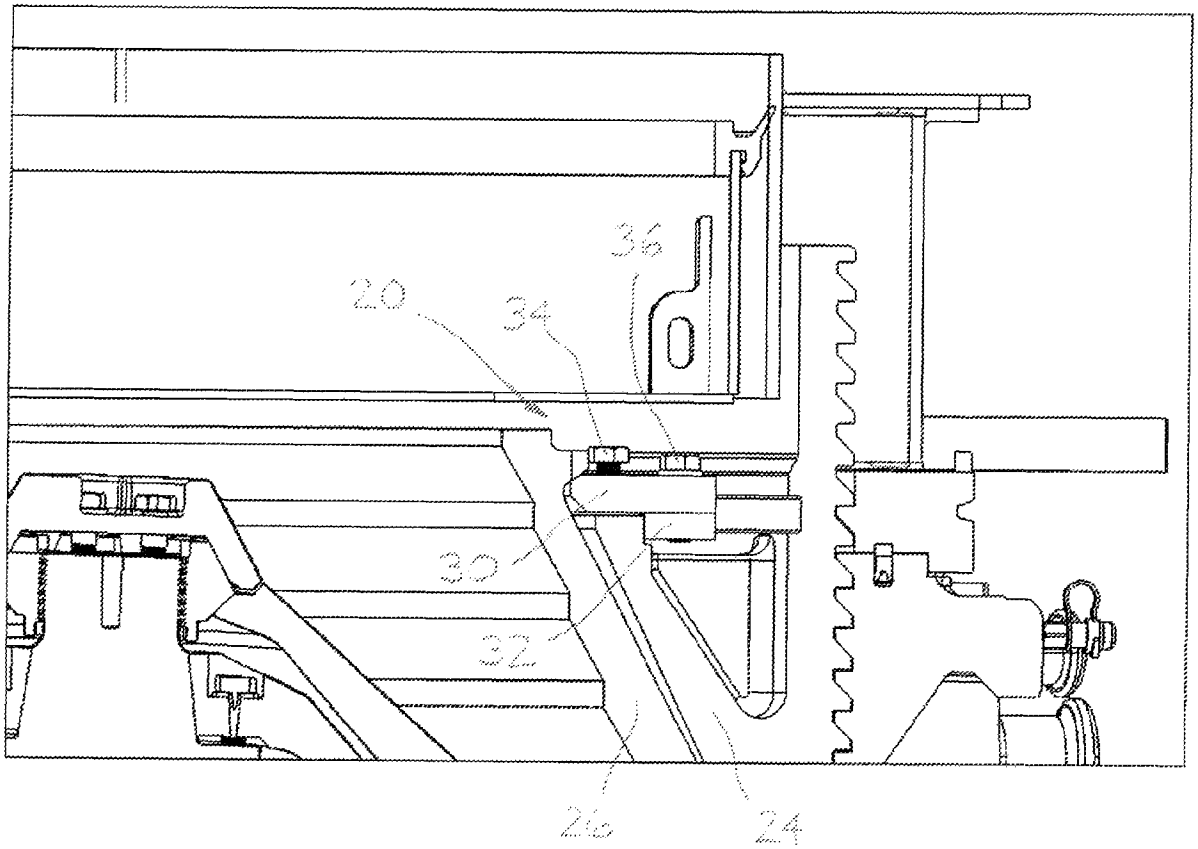
FIG. 2 is a sectional front view of the preferred embodiment of the liner system illustrated in FIG. 1.

Referring now to FIG. 2, a sectional front view of preferred liner system 20 is illustrated. As shown in FIG. 2, preferred liner system 20 comprises support bowl 24, concave ring 26, collet segment 30, link plate 32, collet adjuster 34 and link plate fastener 36.

Figure 3:
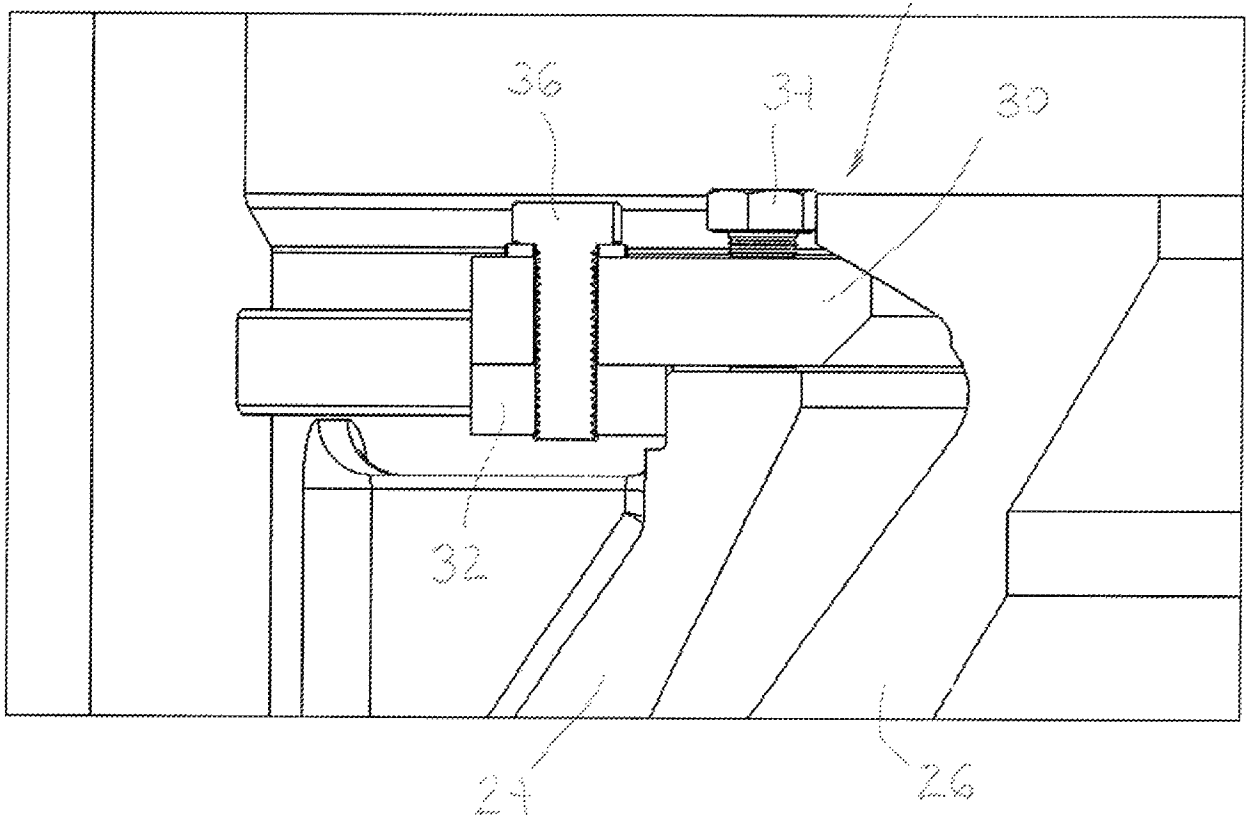
FIG. 3 is a sectional front view of the preferred liner system illustrated in FIGS. 1-2.

Referring now to FIG. 3, a sectional front view of preferred liner system 20 is illustrated. As shown in FIG. 3, preferred liner system 20 comprises support bowl 24, concave ring 26, collet segment 30, link plate 32, collet adjuster 34 and link plate fastener 36. Preferred link plate 32 is in close proximity to support bowl 24 so as to facilitate the centering of concave ring 26 during adjustment of liner system 20.

Figure 4:
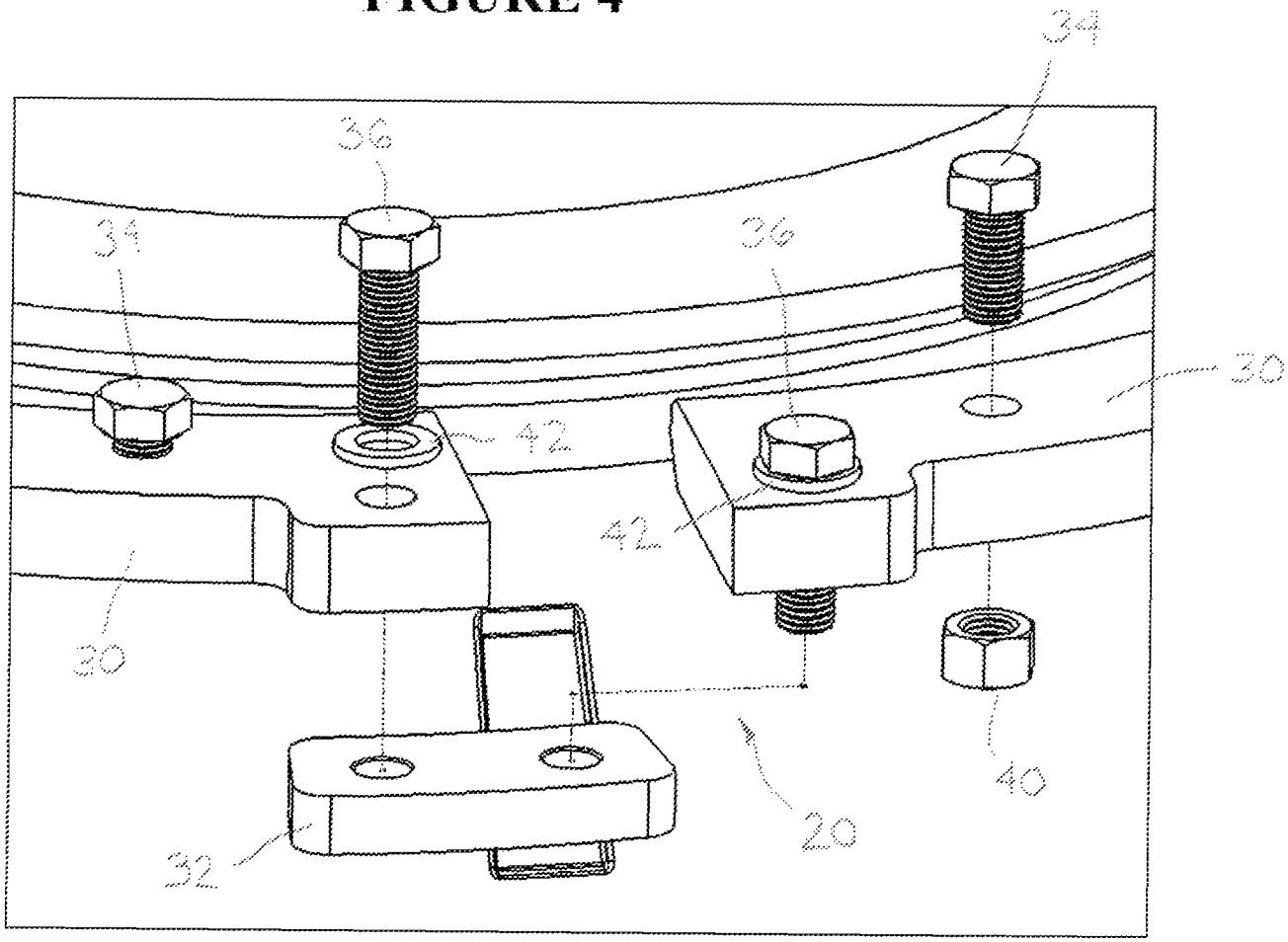
FIG. 4 is a sectional front view of the preferred liner system illustrated in FIGS. 1-3.

Referring now to FIG. 4, an exploded perspective view of preferred liner system 20 is illustrated. As shown in FIG. 4, preferred liner, system 20 comprises collet segments 30, link plate 32, collet adjusters 34, link plate fasteners 36 and threaded insert 40. More particularly, preferred liner system 20 includes at least two collet segments that are adapted to apply a force to the concave ring, at least two link plates each of which is adapted to be attached to two of the collet segments, at least two collet adjusters each of which is adapted to lower and raise a collet segment, and at least four link plate fasteners each of which is adapted to attach a link plate to a collet segment. In the preferred liner system 20, each of the collet adjusters 34 is adapted to apply a three to the support bowl and the concave ring. Preferred liner system 20 also includes washers 42. While FIG. 4 illustrates the preferred configuration and arrangement of the link plate, it is contemplated within the scope of the invention that the link plate includes a slot adapted to receive a link plate fastener so as to allow the liner system to be adjusted without detaching or removing the link plate from the collet segments during adjustment of the liner system.

Figure 5:
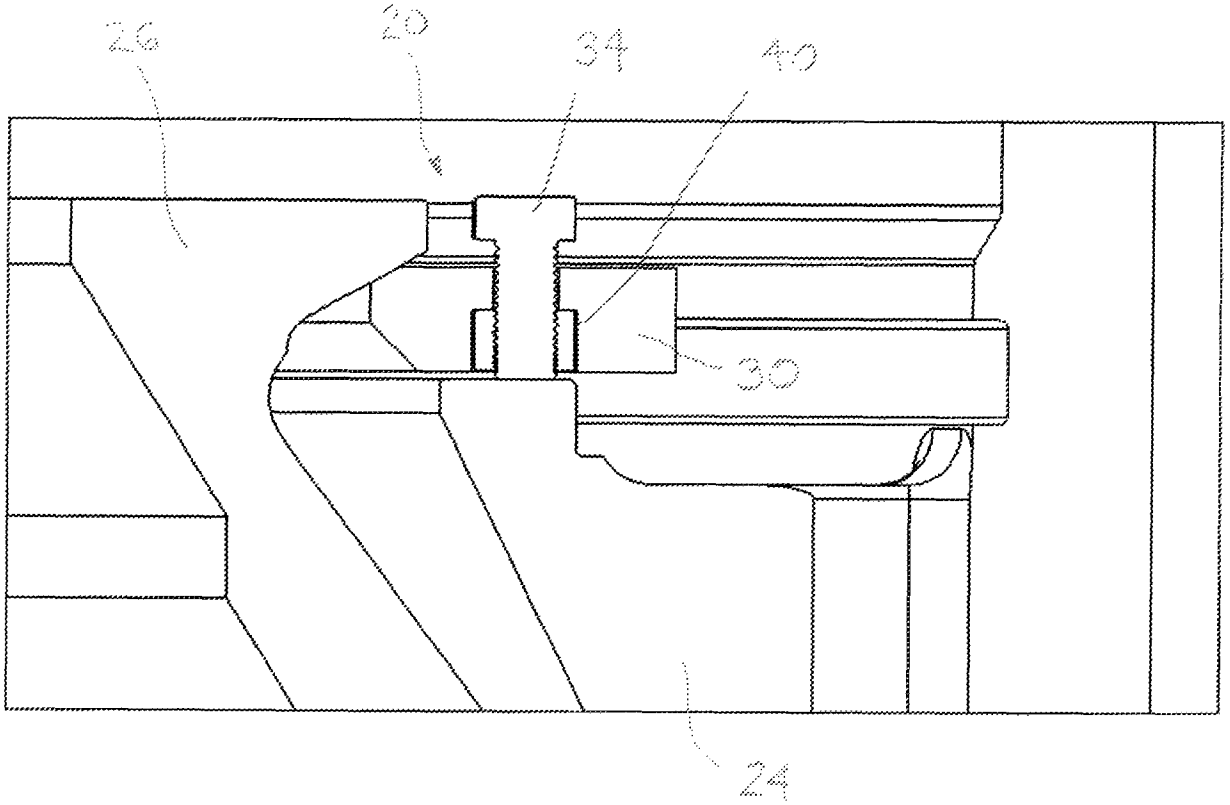
FIG. 5 is an exploded perspective view of the preferred embodiment of the liner system illustrated in FIGS. 1-4.

Referring now to FIG. 5, a sectional front view of preferred liner system 20 is illustrated. More particularly, FIG. 5 is a sectional view of preferred liner system taken along line A-A of FIG. 7. As shown in FIG. 5, preferred liner system 20 comprises support bowl 24, concave ring 26, collet segment 30, collet adjuster 34 and threaded insert 40. The preferred threaded insert 40 is adapted to contact and interact with collet adjuster 34 so as to lower and raise collet segment 30. The preferred threaded insert is a nut, however, it is contemplated within the scope of the invention that the threaded insert is any suitable device, mechanism, assembly or combination thereof that is adapted to contact and interact with the collet adjuster so as to lower and raise collet segment 30. It is also contemplated that the collet, the concave ring and/or the support bowl comprises a threaded portion or threaded insert that is adapted to contact and interact with the collet adjuster so as to lower and raise the collet.

Figure 6:
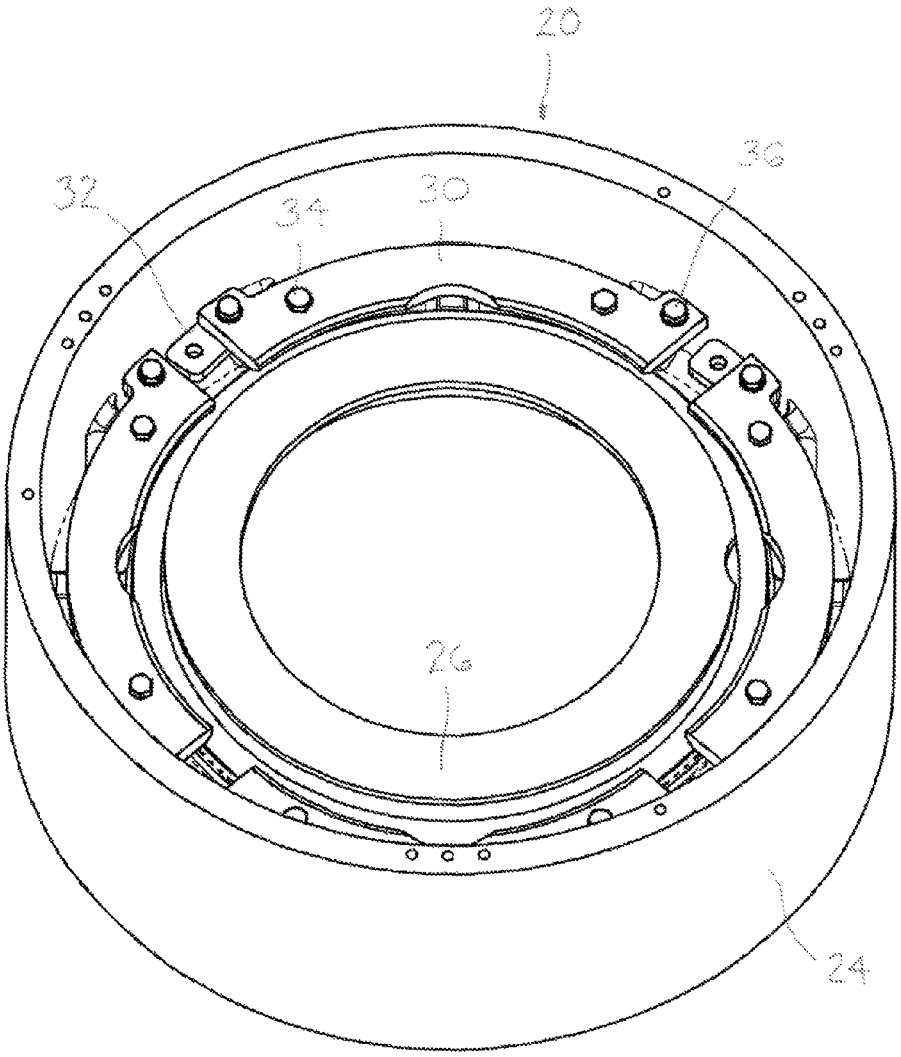
FIG. 6 is a perspective view of the preferred liner system illustrated in FIGS. 1-5.

Referring now to FIG. 6, a perspective view of preferred liner system 20 is illustrated. More particularly, FIG. 6 illustrates preferred liner system 20 in a disassembled condition. As shown in FIG. 6, preferred liner system comprises support bowl 24, concave ring 26, collet segments 30, link plates 32, collet adjusters 34 and link plate fasteners 36.

Figure 7:
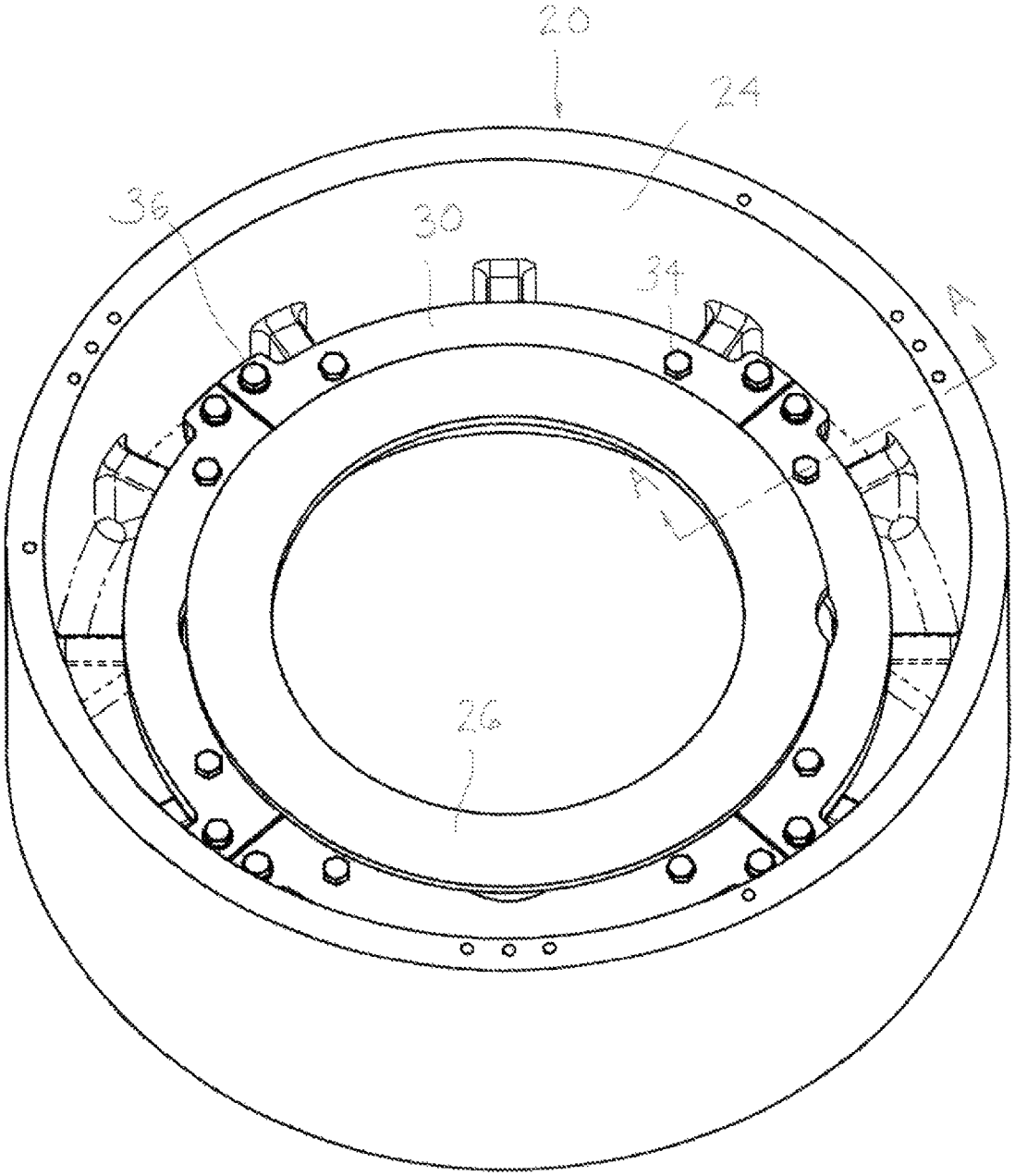
FIG. 7 is a perspective view of the preferred liner system illustrated in FIGS. 1-6.

Referring now to FIG. 7, a perspective view of preferred liner system 20 is illustrated. More particularly, FIG. 7 illustrates preferred liner system 20 in an assembled condition. As shown in FIG. 7, preferred liner system comprises support bowl 24, concave ring 26, collet segments 30, collet adjusters 34 and link plate fasteners 36. Preferred liner system 20 is generally disposed between support bowl 24 and concave ring 26 when the system is in an assembled condition.

Figure 8:
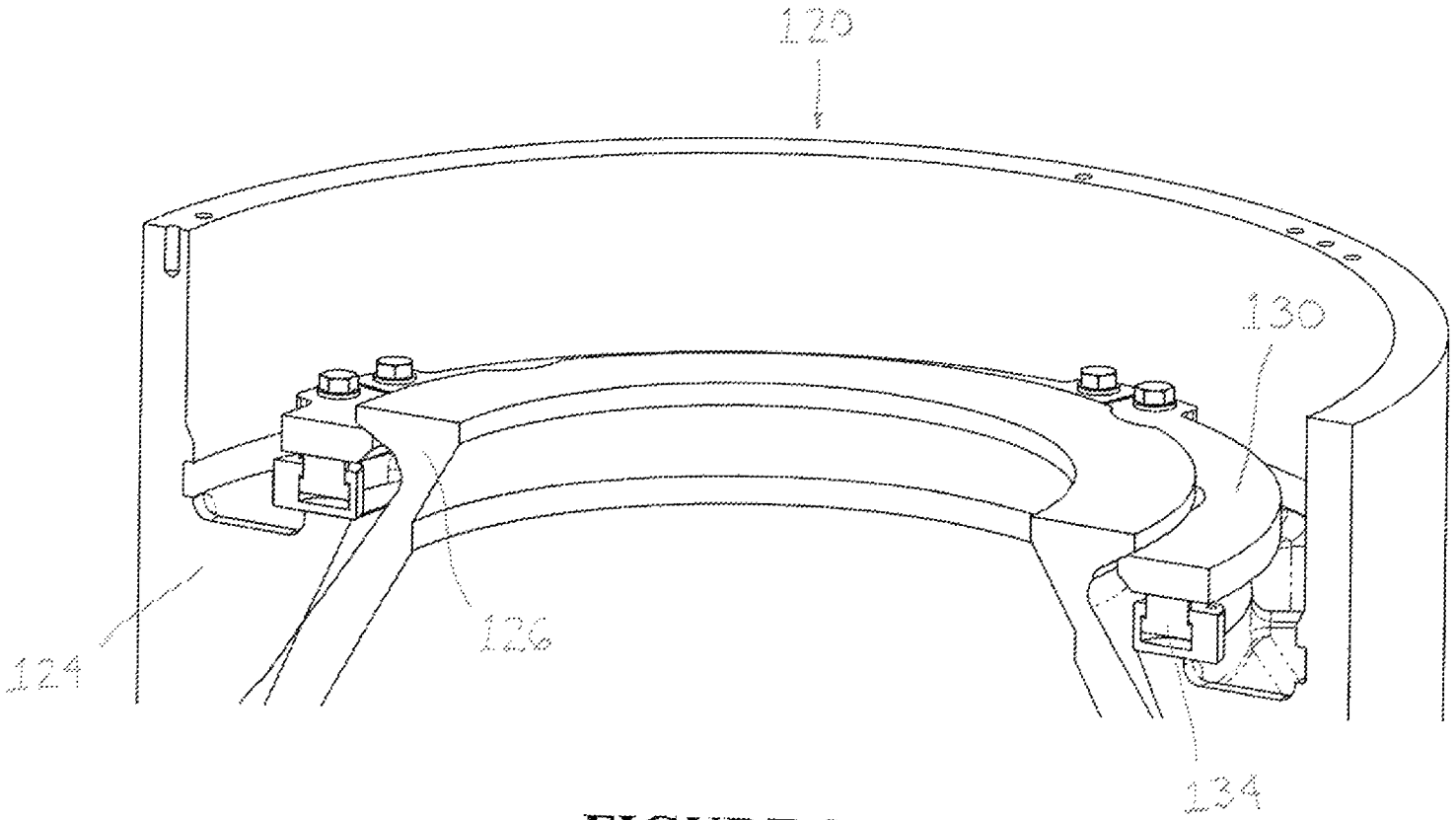
FIG. 8 is a sectional perspective view of a first alternative embodiment of the liner system in accordance with the present invention.

Referring now to FIG. 8, a sectional perspective view of a first alternative embodiment of the liner system in accordance with the present invention is illustrated. As shown in FIG. 8, the first alternative embodiment of the liner system in accordance with the present invention is designated generally by reference numeral 120. Preferred liner system 120 comprises actuators 134 which are adapted to lower and raise concave ring 126. Preferred actuators 134 are disposed between support bowl 124 and collet segments 130. Preferred actuators 134 include without limitation pneumatic and hydraulic cylinders.

Figure 9:
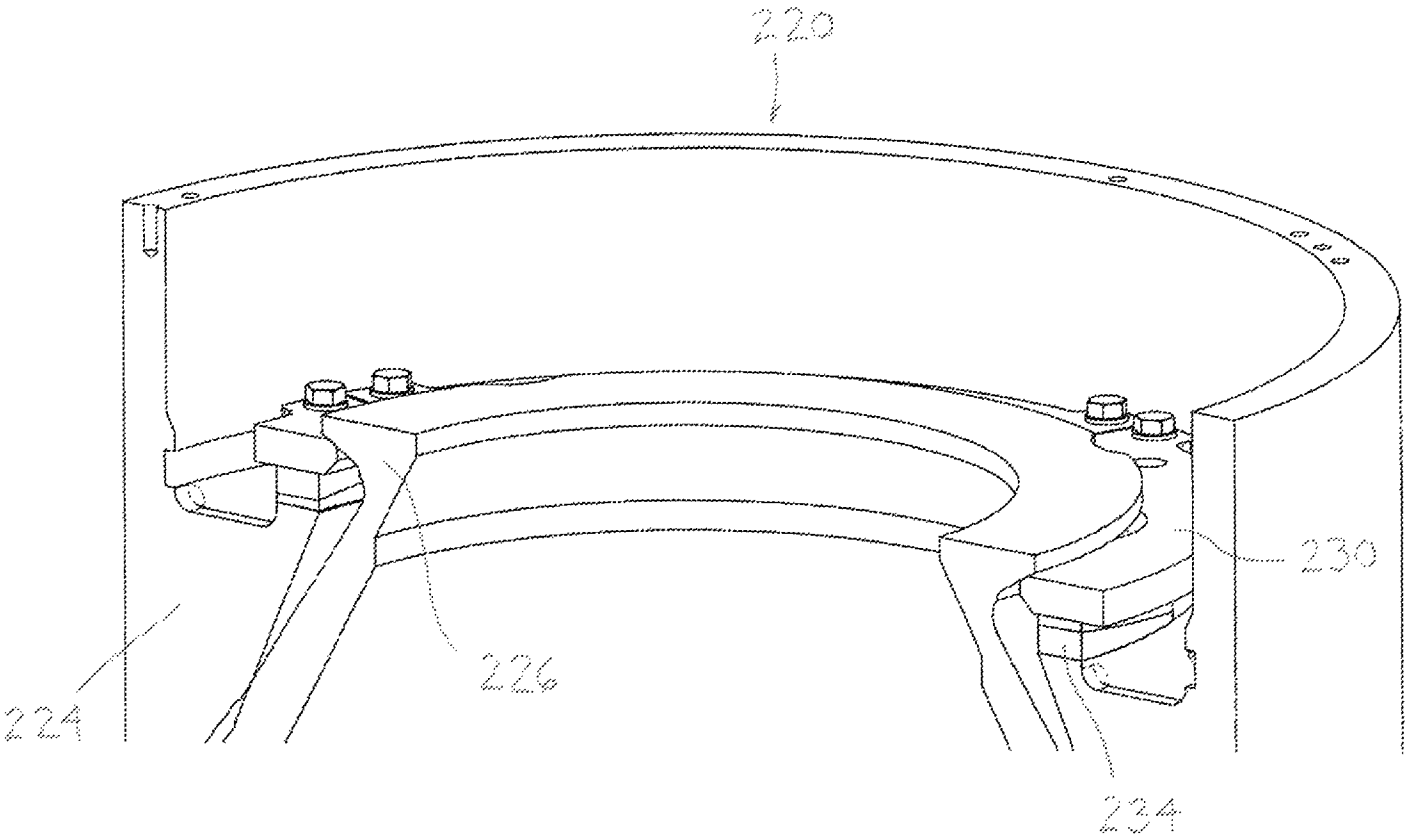
FIG. 9 is a sectional perspective view of a second alternative embodiment of the liner system accordance with the present invention.

Referring now to FIG. 9, a sectional perspective view of a second alternative embodiment of the liner system in accordance with the present invention is illustrated. As shown in FIG. 9, the second alternative embodiment of the liner system in accordance with the present invention is designated generally by reference numeral 220. Preferred liner system 220 comprises wedges 234 which are adapted to lower and raise concave ring 226. Preferred wedges 234 are disposed between support bowl 224 and collet segments 230. Preferably, wedges 234 are machined into or welded to collet segments 230, but it is contemplated within the scope of the invention that the wedges may be attached to the collet segments or the support bowl by any suitable means. It is also contemplated within the scope of the invention that the wedges may extend around the entire circumference of liner system.

Figure 10:
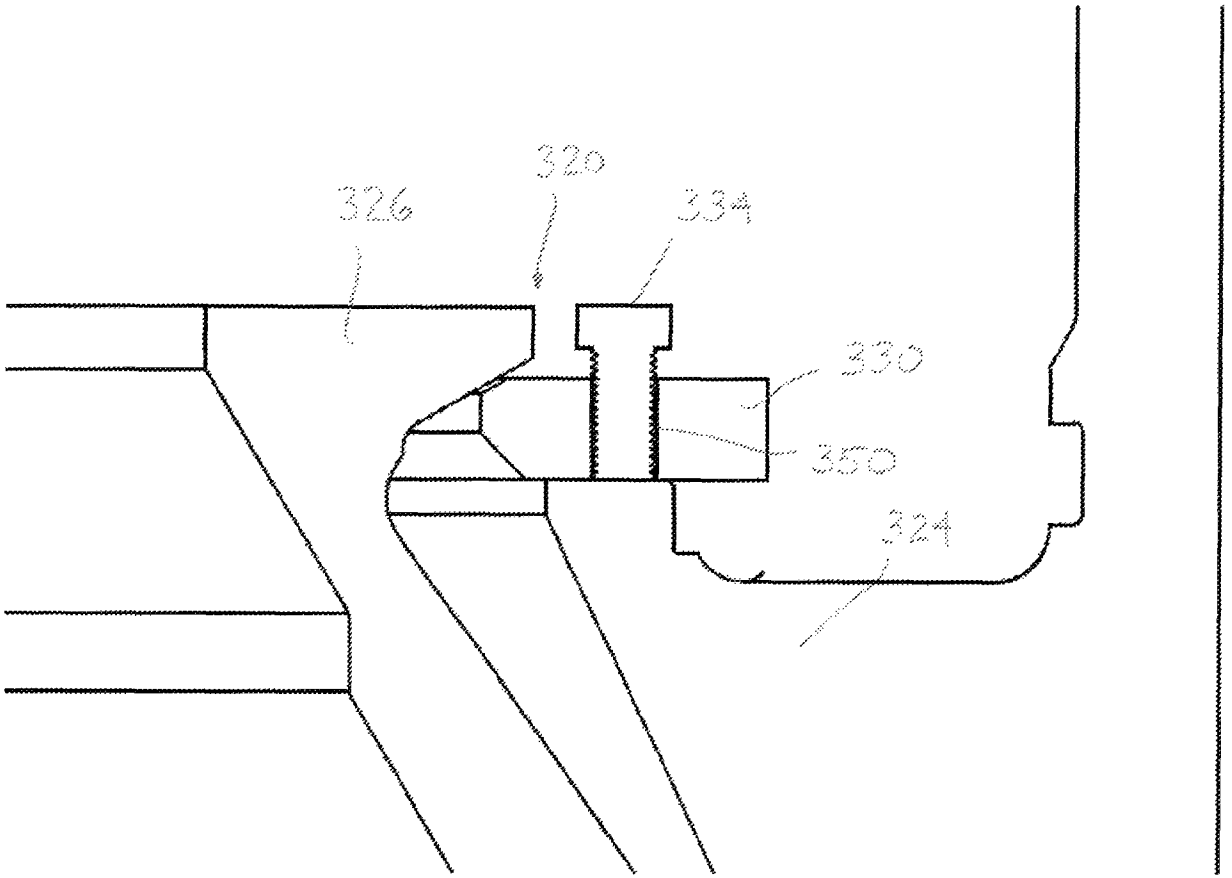
FIG. 10 is a sectional front view of a third alternative embodiment of the liner system in accordance with the present invention is illustrated.

Referring now to FIG. 10, a sectional front view of a third alternative embodiment of the liner system in accordance with the present invention is illustrated. As shown in FIG. 10, the third alternative embodiment of the liner system in accordance with the present invention is designated generally by reference numeral 320. Preferred liner system 320 comprises collet segment 330 having collet segment threaded portion 350. Preferred collet segment threaded portion 350 is adapted to contact and interact with collet adjuster 334 so as to lower and raise collet segment 330 and removably retain concave ring 326. Preferred collet adjuster 334 bears against support bowl 324.

Figure 11:
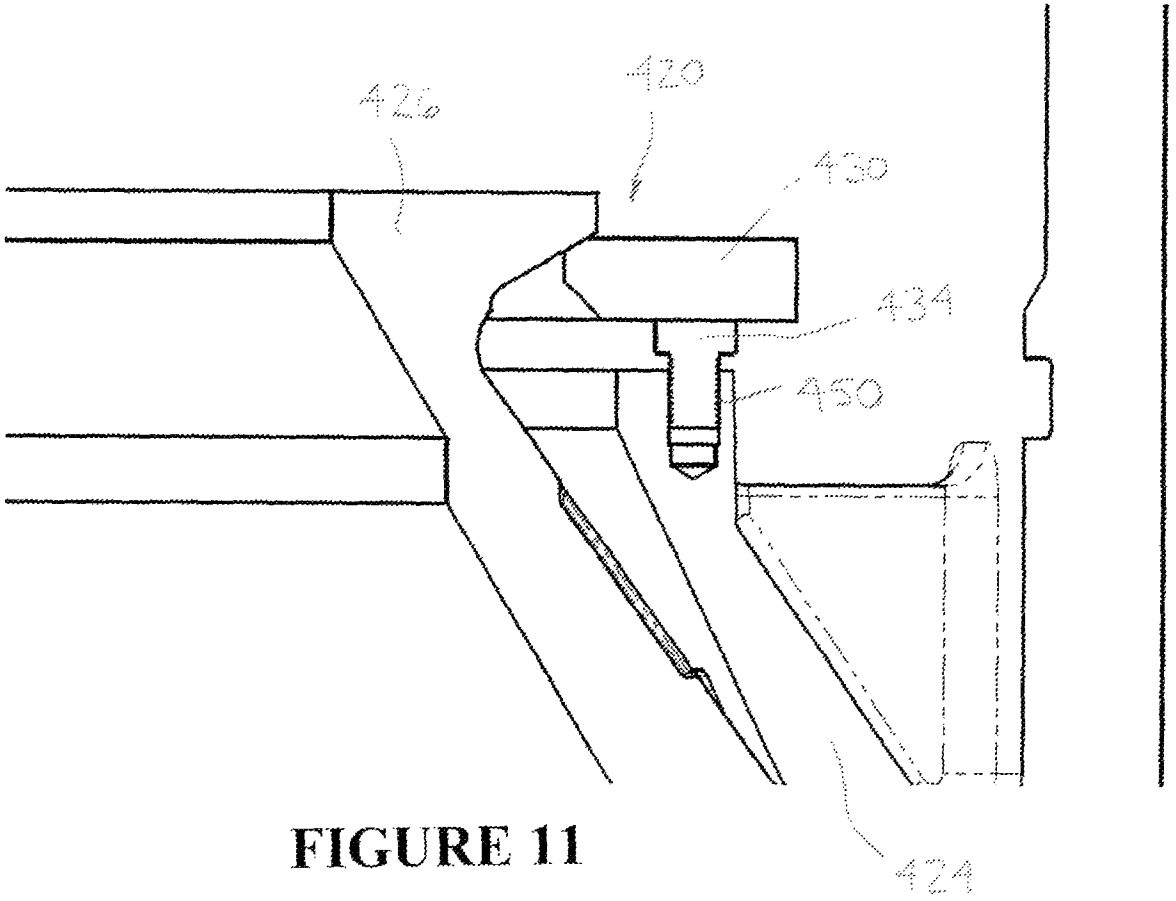
FIG. 11 is a sectional front view of a fourth alternative embodiment of the liner system in accordance with the present invention.

Referring now to FIG. 11, a sectional front view of a fourth alternative embodiment of the liner system in accordance with the present invention is illustrated. As shown in FIG. 11, the fourth alternative embodiment of the liner system in accordance with the present invention is designated generally by reference numeral 420. Preferred liner system 420 comprises support bowl 424 having support bowl threaded portion 450. Preferred support bowl threaded portion 450 is adapted to contact and interact with collet adjuster 434 so as to lower and raise collet 430 and removably retain concave ring 426.

Figure 12:
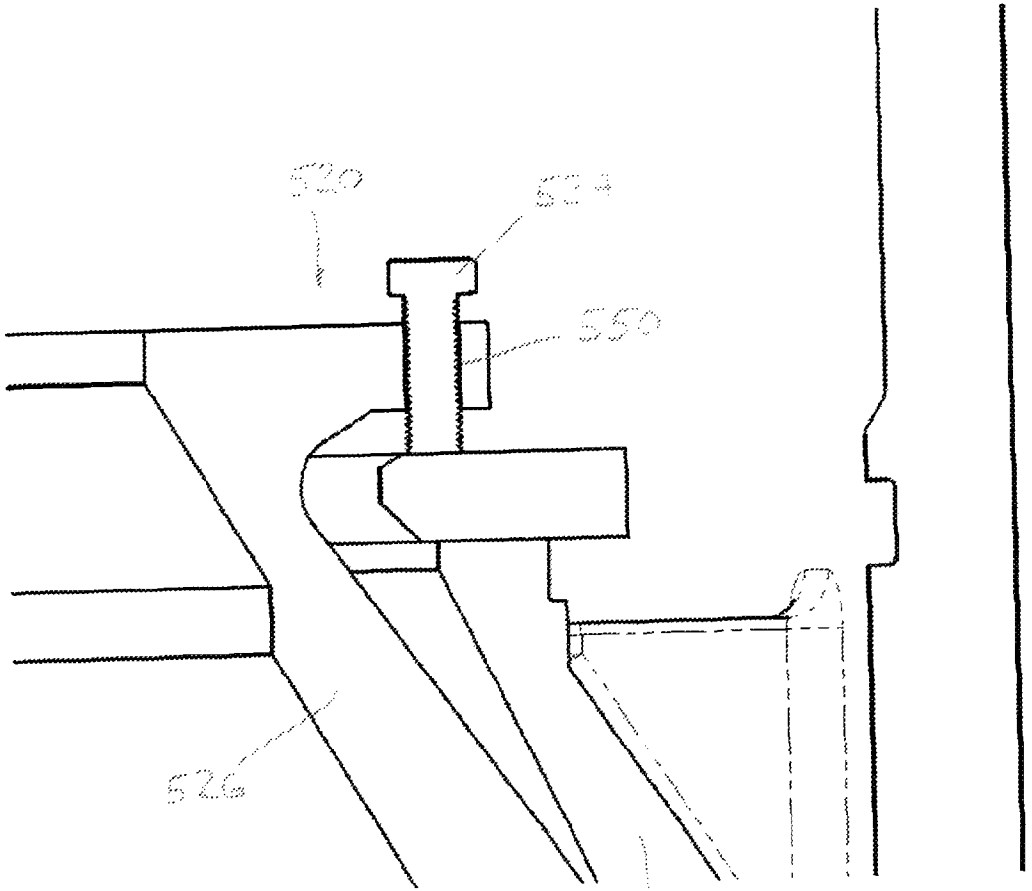
FIG. 12 is a sectional front view of a fifth alternative embodiment of the liner system in accordance with the present invention.

Referring now to FIG. 12, a front perspective view of a fifth alternative embodiment of the liner system in accordance with the present invention is illustrated. As shown, in FIG. 12, the fifth alternative embodiment of the liner system in accordance with the present invention is designated generally by reference numeral 520. Preferred liner system 520 comprises concave ring 526 having concave ring threaded portion 550. Preferred concave ring threaded portion 526 is adapted to contact and interact with collet adjuster 534 so as to lower and raise the concave ring.

Figure 13:
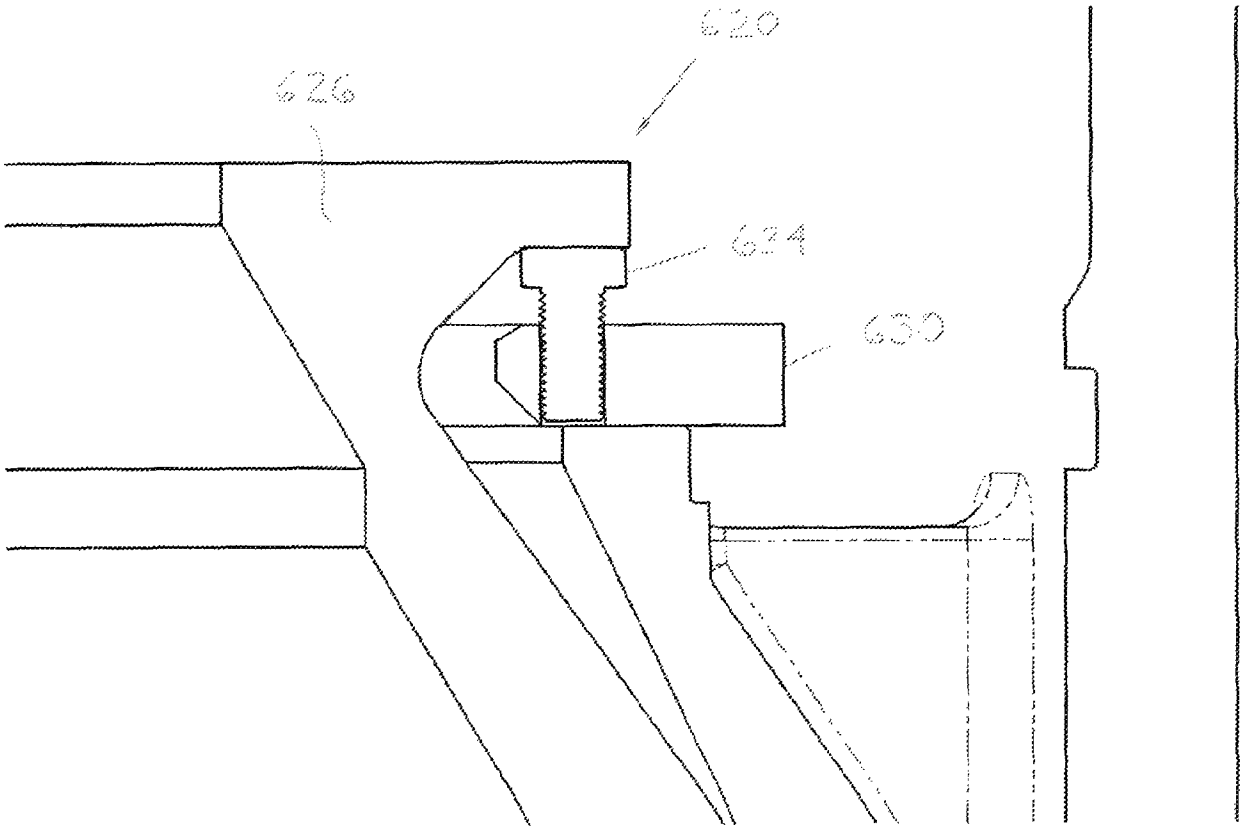
FIG. 13 is a sectional front view of a sixth alternative embodiment of the liner system in accordance with the present invention.

Referring now to FIG. 13, a sectional front view of a sixth alternative embodiment of the liner system in accordance with the present invention is illustrated. As shown in FIG. 13, the sixth alternative embodiment of the liner system in accordance with the present invention is designated generally by reference numeral 620. Preferred liner system 620 comprises concave ring 626 and collet adjuster 634. Preferred collet adjuster 634 adapted to contact and interact with collet 630 so as to lower and raise concave ring 626. In addition, preferred collet adjuster 634 is adapted to contact concave ring 626.

The method of the invention comprises a method for adjusting a collet. The preferred method for adjusting a collet comprises providing a liner system. The preferred liner system comprises a collet that is adapted to apply a force to the concave ring and a collet adjuster that is adapted to lower and raise the collet. In the preferred liner system, the concave ring is removably retained in the support bowl of the rock crusher by the liner system. The preferred method further comprises adjusting the collet adjuster so as to removably retain the concave ring.

In operation, several advantages of the preferred embodiments of the invention are achieved. For example, the preferred embodiments of the liner system are adapted to reduce the cost and complexity and improve the safety of the liner system. The preferred embodiments of the invention claimed herein also reduce the time and effort required to install and remove a liner such as a concave ring.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A liner system adapted for use with a rock crusher having a support bowl and a concave ring, said liner system comprising:

(a) a collet, said collet being configured to directly contact and apply a force to the concave ring; and (b) a collet adjuster, said collet adjuster being configured to lower and raise the collet;

wherein the concave ring is removably retained in the support bowl of the rock crusher by the liner system.

2. The liner system of claim 1 wherein the collet adjuster is configured to contact the support bowl.

3. The liner system of claim 1 wherein the collet adjuster is configured to contact the concave ring.

4. The liner system of claim 1 wherein the collet adjuster comprises an actuator.

5. The liner system of claim 1 wherein the collet adjuster comprises a wedge.

6. The liner system of claim 1 wherein the collet adjuster comprises a bolt.

7. The liner system of claim 1 further comprising a threaded insert.

8. The liner system of claim 7 wherein the threaded insert comprises a nut.

9. The liner system of claim 1 wherein the collet comprises a threaded portion.

10. The liner system of claim 1 further comprising a link plate, said link plate being configured to be attached to the collet.

11. The liner system of claim 10 further comprising a link plate fastener, said link plate fastener being configured to attach the link plate to the collet.

12. A liner system adapted for use with a rock crusher having a support bowl and a concave ring, said liner system comprising:

(a) at least two collet segments, said at least two collet segments being configured to directly contact and apply a force to the concave ring;

(b) at least two collet segment adjusters, each of said at least two collet segment adjusters being configured to lower and raise one of the at least two collet segments;

(c) at least two link plates, each of said at least two link plates being configured to be attached to two of the at least two collet segments; and (d) at least four link plate fasteners, each of said at least four link plate fasteners being configured to attach one of the at least two link plates to one of the at least two collet segments;

wherein the concave ring is removably retained in the support bowl of the rock crusher by the liner system.

13. The liner system of claim 12 wherein each of the at least two collet segment adjusters is configured to apply a force to the support bowl.

14. The liner system of claim 12 wherein each of the at least two collet segment adjusters is configured to apply a force to the concave ring.

15. The liner system of claim 12 wherein the at least two collet segment adjusters comprise an actuator.

16. The liner system of claim 12 wherein the at least two collet segment adjusters comprise a wedge.

17. The liner system of claim 12 wherein the at least two collet segment adjusters comprise a bolt.

18. The liner system of claim 12 further comprising at least two collet segment threaded inserts.

19. The liner system of claim 18 wherein the at least two collet segment threaded inserts comprise a nut.

20. The liner system of claim 12 wherein the at least two collet segments comprise a threaded portion.

21. A method for adjusting a collet, said method for adjusting a collet comprising:

(a) providing a liner system adapted for use with a rock crusher having a support bowl and a concave ring, said liner system comprising:

(i) a collet, said collet being configured to directly contact and apply a force to the concave ring; and (ii) a collet adjuster, said collet adjuster being configured to lower and raise the collet;

wherein the concave ring is removably retained in the support bowl of the rock crusher by the liner system; and (b) adjusting the collet adjuster so as to removably retain the concave ring.

* * * * *